United States Patent [19]

Masbruch et al.

[11] Patent Number: 5,064,010

[45] Date of Patent: Nov. 12, 1991

[54] SPEED AND STEERING CONTROL FOR SCRUBBERS AND THE LIKE

[75] Inventors: Richard D. Masbruch, Ransomville; Arthur A. Andrews, Alden, both of N.Y.

[73] Assignee: Tennant Company, Minneapolis, Minn.

[21] Appl. No.: 369,129

[22] Filed: Jun. 21, 1989

[51] Int. Cl.[5] ..... B62D 11/04

[52] U.S. Cl. ..... 180/6.5; 180/19.03; 15/340.2

[58] Field of Search ..... 15/340.2, 340.1, 50 R, 15/DIG. 10; 180/6.4, 6.44, 6.48, 6.5, 6.32, 19.1, 19.3, 315, 332; 74/488, 504

[56] References Cited

U.S. PATENT DOCUMENTS

| | | | |
|---|---|---|---|
| 644,853 | 3/1900 | Fahl | 180/6.5 |
| 3,168,157 | 2/1965 | Ulinski | 180/19.3 |
| 3,190,994 | 6/1965 | Becker et al. | 74/488 |
| 3,465,841 | 9/1969 | Pulskamp et al. | 180/19.3 |
| 3,823,791 | 7/1974 | Sheler | 180/6.66 |
| 3,893,530 | 7/1975 | Gordon | 180/6.5 |
| 3,952,361 | 4/1976 | Wilkins | 15/319 |
| 4,010,507 | 3/1977 | Johnson | 15/49 R |
| 4,380,844 | 4/1983 | Waldhauser | 15/320 |
| 4,697,661 | 10/1987 | Pajerski | 180/19.3 |
| 4,709,771 | 12/1987 | Basham et al. | 180/6.5 |

FOREIGN PATENT DOCUMENTS

| | | | |
|---|---|---|---|
| 0567716 | 1/1957 | Canada | 180/6.5 |
| 0073725 | 3/1983 | European Pat. Off. . | |
| 0173393 | 3/1986 | European Pat. Off. . | |
| 0320735 | 6/1989 | European Pat. Off. | 15/50 R |

OTHER PUBLICATIONS

Tennant Bulletin 760 Ice Resurfacer.

*Primary Examiner*—Charles A. Marmor
*Assistant Examiner*—Anne Marie Boehler
*Attorney, Agent, or Firm*—Kinzer, Plyer, Dorn, McEachran & Jambor

[57] ABSTRACT

A floor scrubber which is operated by a person walking behind it has two drive wheels individually powered by two reversible electric motors. The rotational speeds and directions of these motors determine forward or reverse travel, the travel speed and the steering of the scrubber, all of which are controlled by the operator through a straight transverse handlebar attached to the rear of the scrubber frame. The handlebar can be twisted to control travel speed in forward or reverse and tilted to control steering right or left while still allowing manual force to be applied directly to the scrubber frame through the handlebar independently of the speed and steering control movements. Travel speed and sharpness of steering are proportional to the magnitude of handlebar movements. Steering can be accomplished at any travel speed including zero, and can be as sharp as turning about the centerline of the machine.

14 Claims, 2 Drawing Sheets

SPEED AND STEERING CONTROL FOR SCRUBBERS AND THE LIKE

BACKGROUND

There is a class of powered mobile machines, such as floor scrubbers and sweepers, in which the machine is operated by an attendant walking behind it. Machines of this type are used to clean large floor areas such as factories, and for such indoor service a battery powered machine is usually preferred. In the case of a scrubber, the large areas to be scrubbed necessitate sizeable water tanks on the machine which, along with the heavy batteries, cause the machine to be so heavy that a powered traction drive is essential and power assisted steering is desirable. Some walk-behind scrubbers use one traction motor driving two drive wheels through a differential gear. On such scrubbers individual clutches or brakes on the drive wheels have been used to assist steering, but some of these have been less durable than desired. Other scrubbers have been fitted with two traction motors, one to power each drive wheel, with means being provided for the operator to control the speeds of these motor in unison for speed control and differentially for power steering. This is an improvement over the single motor approach, and is coming to be the common method, at least in the heavier machines. However, the control means which have been used still do not provide optimum ease of handling. They tend to respond slower than smaller scrubbers which are light enough to be steered manually. A faster steering response can be obtained if the operator can help steer the machine by manually pushing on the controls to supplement the power steering, but pushing on the controls of some models may increase the machine travel speed to maximum before any manual steering occurs, which could be hazardous. Some machines provide a programmed rate of change in the differential speed of the two motors, which turns the machine at a pre-established rate even though the operator might want to make a quicker turn under some circumstances.

Therefore in this class of machines there is a need for a control system that will make a machine more responsive and maneuverable than previously available models. It should provide full power steering while at the same time permitting the operator to apply manual force to the machine to assist the steering without affecting the speed control or power steering. It should cause steering and travel speed to respond in proportion to the degree of movement given to the controls rather than at a preprogrammed rate. Also, it should be capable of making a turn as sharp as turning about the centerline of the machine, and without forward or reverse travel if desired, for maximum maneuverability in tight spaces. The present invention provides these improvements.

SUMMARY OF THE INVENTION

A machine, which may be a floor maintenance machine such as a sweeper, scrubber or the like, is operated by an attendant walking behind it. A floor scrubber will be used for illustration. The scrubber has two drive wheels that support a substantial portion of its weight. Each drive wheel is powered by an individual electric motor which is capable of forward or reverse rotation.

In the preferred embodiment of the invention each of these motors is controlled by a commercially available solid state electronic motor controller, and each of these in turn is controlled by a potentiometer. The potentiometers are made to signal neutral or no motor rotation to the controllers at an intermediate voltage. Moving the potentiometers from this intermediate voltage to a higher voltage produces one direction of motor rotation, while moving them from the intermediate voltage to a lower voltage produces the opposite direction of motor rotation. Thus external switches are not needed for reversing the motors.

The two potentiometers are mechanically linked to a straight transverse handlebar which is located at the rear of the machine where it is convenient to the operator. The handlebar is attached to the frame of the machine by a central pivot bracket in such a way that the handlebar may be rotated or twisted about its own long centerline, and also tilted or pivoted about a central axis. This axis is chosen for the comfort of the operator, and seems best when the ends of the handlebar tilt down and forward or up and back at about 30 degrees from vertical because this is substantially in line with the arms of an average height operator.

The linkages which connect the potentiometers to the handlebar cause both potentiometers to move equally and in the same direction when the handlebar is rotated about its long centerline, but equally and in opposite directions when the handlebar is tilted. Since the two potentiometers control the two drive motors, this arrangement results in a control system whereby the operator rotates the handlebar forward to go forward, and the farther he or she rotates it the faster the travel speed becomes. The operator rotates the handlebar backward for reverse travel, and again the farther it is rotated the faster the machine moves in reverse. Maximum speeds in both directions are restricted to safe limits and between forward and reverse is a stable neutral band where there is no travel speed. Steering is accomplished simply by tilting down the appropriate end of the handlebar. If the handlebar is not rotated, so there is no travel speed, but one end of the handlebar is tilted down, one potentiometer will be moved forwardly and the other one in reverse, which will cause one drive wheel to turn forward and the other one backward. The machine can thus be turned on its own center if desired without any forward or reverse travel. This gives a more responsive maneuverability than many previous machines of this class have had.

Simultaneously rotating and tilting the handlebar will result in differential movements of the potentiometers that will cause both drive motors to turn in the same direction, but one will turn faster than the other. This combination of travel speed and steering will produce a gradual turn in either forward or reverse travel direction as selected by the operator.

The handlebar is secured to the machine frame through its central pivot bracket so the operator may, if he or she wishes, apply a manual force in any direction to the machine by pushing equally on both ends of the handlebar in the selected direction. This will not affect the rotation or the tilt that the operator has set into the handlebar, so will have no effect on the controlled speed and steering. However, it will supplement the power steering and add substantially to the natural feel of handling the machine.

Other objects will appear from time to time in the ensuing drawings and description.

DESCRIPTION OF THE PREFERRED EMBODIMENT

Figure 1:
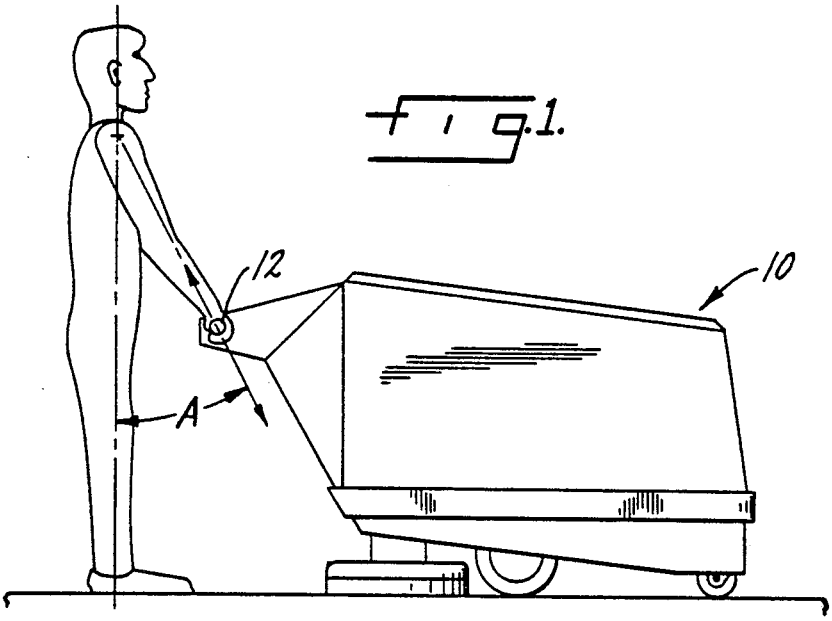
FIG. 1 is a side view showing a person operating a floor scrubber which utilizes the present invention.

The present invention will be described as applied to a floor scrubber, although it is also applicable to other types of machines such as, for example, floor sweepers. The scrubber may be similar to conventional scrubbers now available except for the improved control system which is the subject of this invention. As seen in FIG. 1, the operator walks behind the scrubber, which is identified by the number 10, and controls its speed and steering by placing one or both hands on the hand grips 12 of a straight transverse handlebar which is situated at the rear of the machine and at a convenient height.

Figure 2:
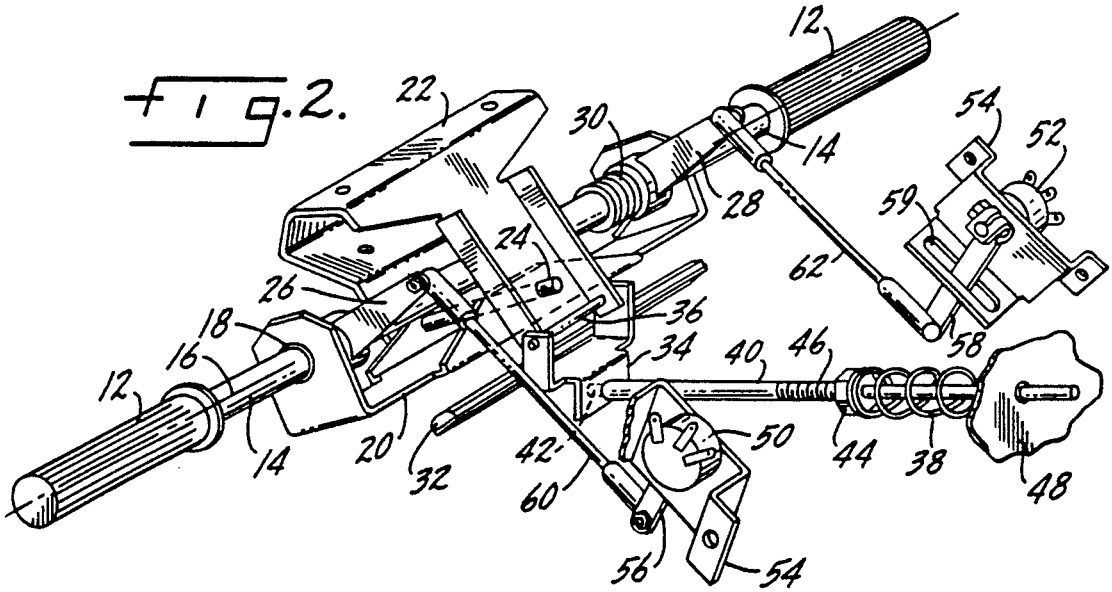
FIG. 2 is a schematic perspective assembly drawing of the system for controlling speed and steering of the scrubber of FIG. 1 showing the preferred embodiment of the invention.

The mechanical construction of this control system is shown in FIG. 2. The handlebar 14 is made of one continuous piece of round steel tubing and is fitted at its ends with hand grips 12. The handlebar has a long centerline or axis 16. Two bushings 18 (only one shown) rotatably support the handlebar in steering yoke 20. There is a mounting bracket 22 which is bolted or otherwise secured to the structure of the scrubber. Steering yoke 20 is pivotally attached to bracket 22 by pivot pin 24, which is held in place by cotter pins through cross holes drilled through it near its ends. By this construction handlebar 14 is thus allowed to rotate about its long centerline or axis 16 and also pivot about an axis established by pivot pin 24.

Two handlebar arms 26 and 28 are secured to handlebar 14 by set screws (not shown). These arms have integral hubs which surround the handlebar and prevent it from sliding endwise through steering yoke 20. A dual throw coil spring 30, similar to those used in door knobs, is mounted about handlebar 14 and is arranged to always return it to a predetermined stationary position. This action effectively places the machine speed control in neutral.

Handlebar 14 and steering yoke 20 can be pivoted about pivot pin 24 by applying a force on one of the hand grips 12 in a direction perpendicular to pivot pin 24. If no such force is applied, the handlebar and steering yoke will be held in a centered, horizontal position by neutral centering arm 32. This component is a plastic bar attached to centering arm support 34, which in turn is pivotally attached to mounting bracket 22 by pin 36.

In FIG. 2, for clarity of illustration, there is some space shown between neutral centering arm 32 and steering yoke 20. In normal service, however, the neutral centering arm is resiliently pressed against the under side of the steering yoke by compression spring 38, acting through push rod 40. This rod has a reduced diameter 42 which fits loosely in a hole in centering arm support 34. The diameter of the opposite end of rod 40 is also reduced enough so that a nut 44 can be run onto a threaded portion 46 of the push rod. Push rod 40 slides freely through a hole in a bulkhead in the scrubber frame, shown fragmentally at 48. Spring 38 is compressed between the bulkhead and nut 44, which can be set to compress the spring as desired.

When the operator wishes to pivot the handlebar about pivot pin 24 he or she may exert a force on one of the hand grips 12 in a direction perpendicular to the pivot pin. This will move down one end of the steering yoke 20, which will in turn push down the centering arm 32 and further compress spring 38. When the operator releases the force on the hand grip the spring pushing up on neutral centering arm 32 will push steering yoke 20 back to level and restore the handlebar to its neutral position. This effectively places the steering control in neutral.

There are two potentiometers 50 and 52 mounted in two mounting brackets 54. These brackets are attached to the structure of the scrubber. The potentiometers have control arms 56 and 58 associated with them. These arms pass through slots 59 in the mounting brackets, the ends of the slots serving to define the amount of rotation available to the handlebar and potentiometers. There are two links 60 and 62 which have conventional ball joints on their ends. These links connect the handlebar arms 26 and 28 with the potentiometer control arms 56 and 58.

Figure 3:
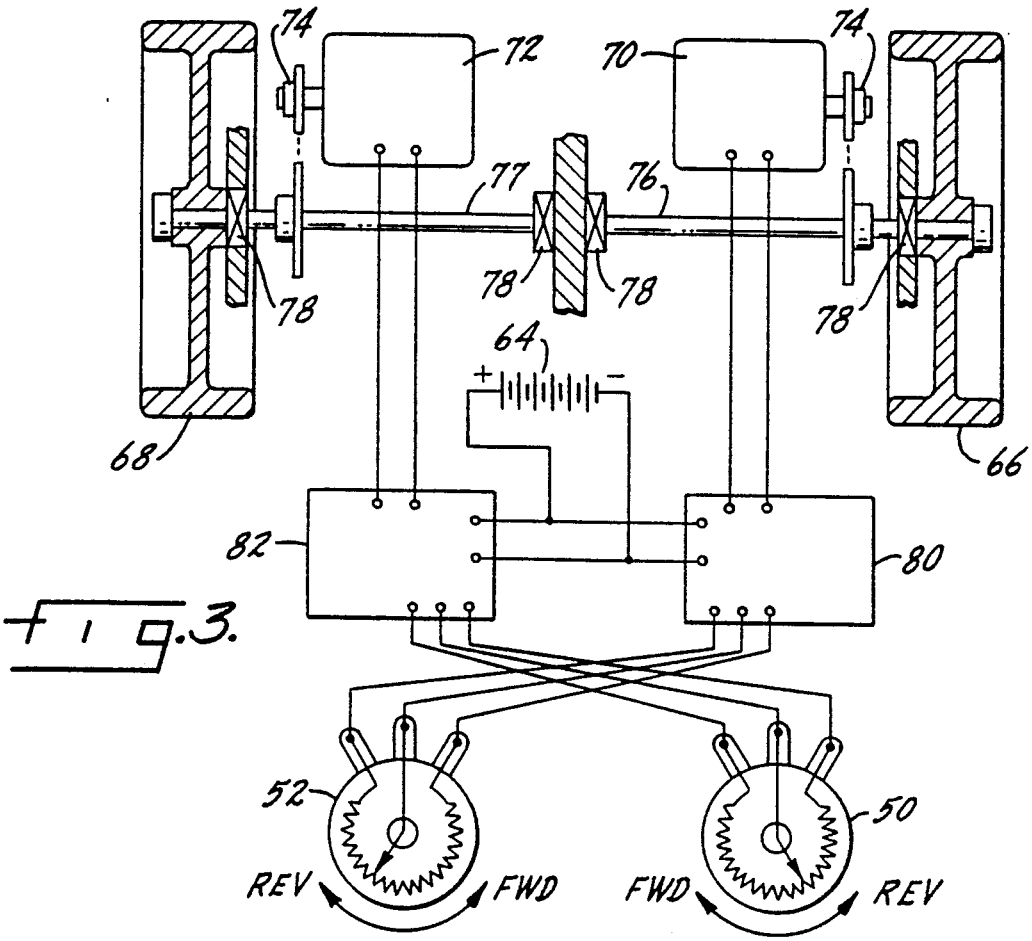
FIG. 3 is a schematic diagram of the electrical circuit and the traction drive of the scrubber.

FIG. 3 shows a schematic diagram of the electrical circuit and the traction drive of the scrubber. The machine is powered by a battery pack indicated at 64. The drive wheels 66 and 68 are driven by two electric motors 70 and 72 through two chain and sprocket drives indicated generally at 74. The drive wheels are mounted on two independent coaxial drive axles 76 and 77, each of which is rotatably supported by two sealed ball bearings 78 mounted on the structure of the scrubber. The two motors 70 and 72 are controlled by two motor controllers 80 and 82. These may be commercially available units such as, for example, those offered by Curtis PMC of Dublin, California. The two motor controllers in turn are controlled by the two potentiometers 50 and 52. The motor controllers are so designed that a mid-range voltage from a potentiometer causes zero rotation of the controlled motor, while voltages below the mid-range will cause motor rotation in one direction and voltages above the mid-range will cause motor rotation in the other direction. The farther the voltage values move from mid-range, the faster the controlled motor will turn. Thus this control system will provide the machine with variable speed forward travel, neutral, and variable speed reverse travel simply by moving the two potentiometers through their range. There is no need for external switches to provide neutral or reverse.

Figure 4:
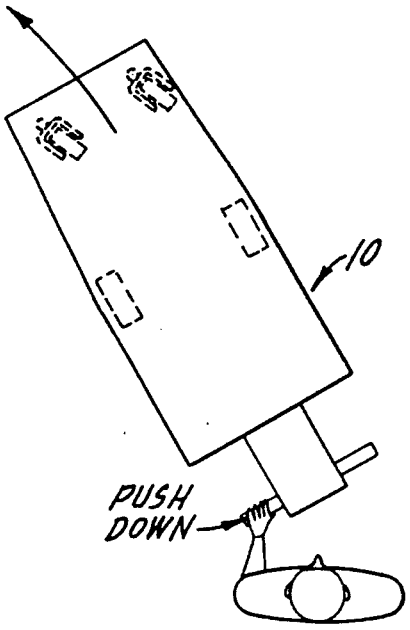
FIG. 4 illustrates a control technique for making a left turn during forward travel
Figure 5:
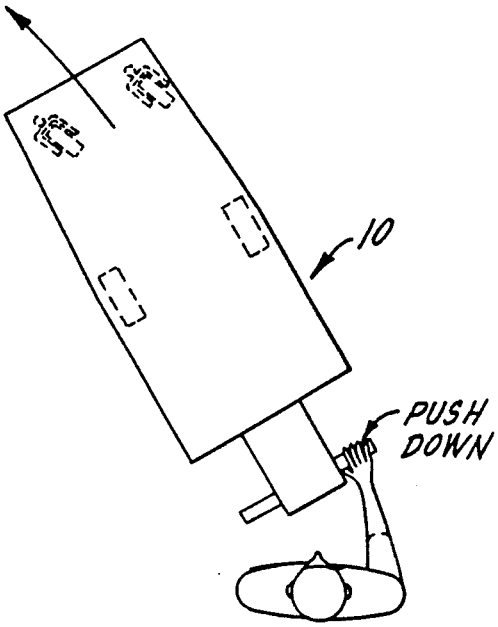
FIG. 5 illustrates an alternative control technique for making a left turn during forward travel.

FIG. 3 shows the left potentiometer 52 controlling the right motor controller 80 and drive wheel 66, and the right potentiometer 50 controlling the left motor controller 82 and drive wheel 68. This arrangement will result in a steering response as shown in FIG. 4, where a downward push on the left hand grip during forward travel will produce a left turn. An alternative arrangement is possible, by not crossing the wires shown crossed in FIG. 3, but instead connecting the right potentiometer 50 to the right motor controller 80 and the left potentiometer 52 to the left motor controller 82. This will give a steering response as shown in FIG. 5, where a downward push on the right hand grip during forward travel produces a left turn. Both arrangements are possible, and either one can be used without affecting the novel aspects of the invention. It should be pointed out that for either arrangement, if a left turn is to be made when the machine is traveling in reverse, it will be necessary to push down the opposite hand grip that the one that is pushed down for a left turn when traveling forward. Also, it should be apparent that right turns can be made in either arrangement and in either forward or reverse travel by pushing down the opposite hand grip than is pushed down for a left turn.

Figure 6:
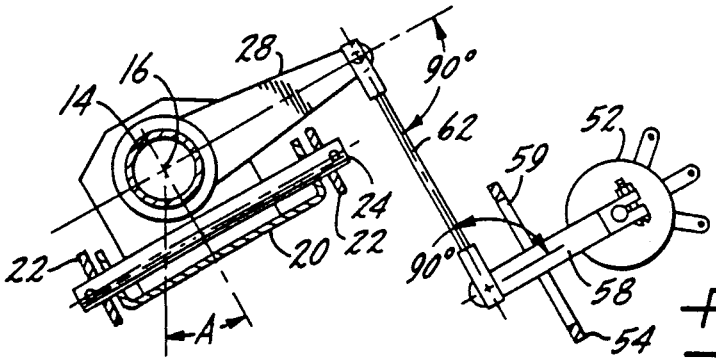
FIG. 6 is a side view, partly in section, of FIG. 2.

It has been found that the steering is most comfortable when angle "A" in FIG. 1 is between 30 and 45 degrees. However, any angle between 0° and 90° can be used. As shown in FIG. 6, pivot pin 24 will lie at right angles to the selected angle. Handlebar arms 26, 28 in their neutral positions should be set parallel to pivot pin 24. The potentiometer brackets 54 should be located so that in neutral the ball jointed links 60, 62 will form right angles with both the handlebar arms 26, 28 and the potentiometer arms 56, 58 and the potentiometer arms are in the middle of the slots 59 in the brackets 54.

The embodiments of the invention in which an exclusive property or privilege is claimed are defined as follows:

1. In a floor maintenance machine with a longitudinal axis to be operated by a person walking behind it and adapted for forward or reverse travel over a floor, the combination of a frame supported at least in part by two drive wheels, each drive wheel being driven individually by an electric motor, each motor being capable of forward or reverse rotation, the two motors being controlled equally or differentially by one manual control, said manual control comprising a straight elongated member with along axis disposed axially centrally of the elongated member and transverse to the longitudinal axis of the machine, the elongated member being adapted to be gripped near its ends by an operator, said elongated member being movable with a first rotary motion in which it may be rotated in some degree about its long axis and movable with a second rotary motion in which it may be pivoted in some degree about a second axis in the vertical plane of the longitudinal axis of the machine, said elongated member being operatively connected to both motors so that by application of its first motion alone both motors can be operated at equal speeds in either forward or reverse rotation, or by application of its second motion alone one motor can be operated in forward rotation and the other motor in reverse rotation or by application of its first and second motions simultaneously both motors can be operated in forward or reverse rotation by at differential speeds, the speeds of the motors in every case being variable proportional to the degree of movement or movements applied to the elongated member.

2. The machine of claim 1 in which translational force applied equally and simultaneously in the same direction to both ends of the elongated transverse member will be transmitted to the machine without affecting control of the speed or steering of the machine.

3. The machine of claim 1 in which the second axis lies at an angle between 30 degrees and 45 degrees with the horizontal, and slopes up and forward in the direction of machine travel.

4. The floor maintenance machine of claim 1 in which the operative connection between the elongated member and the motors comprises a first arm and a second arm both attached to the elongated member, a first control device and a second control device, a first link connecting the first arm with the first control device and a second link connecting the second arm with the second control device, the first and second control devices respectively controlling a first motor controller and a second motor controller, each of which in turn controls one of the two drive motors.

5. The machine of claim 4 in which the control devices are potentiometers.

6. The machine of claims 4 or 5 in which an intermediate voltage in a control device produces zero rotation in its related motor, while a greater voltage produces one direction of rotation of the motor and a lesser voltage produces the opposite direction of rotation of the motor.

7. In a floor maintenance machine to be operated by a person walking behind it and adapted for forward and reverse travel over a floor, a frame having a longitudinal axis and supported at least in part by two drive wheels, each drive wheel being driven an electric motor for forward and reverse rotation, a manual control for controlling the two drive motors, the manual control including a straight elongated member having an axis transverse to the longitudinal axis of the machine and adapted to be gripped about its transverse axis and near its ends by an operator, a mounting for the elongated member permitting the elongated member to be rotated about its transverse axis and simultaneously pivotable about a second axis in the vertical plane of the longitudinal axis of the machine, spring bias means for centering the elongated member in at rest intermediate position about both axes, a pair of controllers mounted on the frame for controlling the motors, one for each motor, and a separate linkage between the elongated member and each of the controllers constructed and arranged so that in response to the rotation of the elongated member about its transverse axis both motors will be operated at equal speed either forward or reverse and in response to pivoting of the elongated member about its second axis in the vertical plane of the longitudinal axis of the machine, the motors will be operated in opposed rotation, said linkage including a pair of generally parallel levers extending radially from the longitudinal member, a lever extending radially from each controller and generally parallel to each other, and a link between each lever on the elongated member and a lever on one of the controllers.

8. The machine of claim 7 further characterized in that the links are approximately at right angles to the levers when the elongated member is in its at least intermediate position.

9. The machine of claim 7 further characterized in that the pivotal axis in the vertical plane of the longitudinal axis of the machine is inclined to the horizontal.

10. The structure machine of claim 7 in which the linkage is constructed and arranged to transmit maximum motion to each of the controllers upon initial rotation of the elongated member about its transverse axis from its at rest intermediate position.

11. In a floor maintenance machine to be operated by a person walking behind it and adapted for forward and reverse travel over a floor, a frame having a longitudinal axis and supported at least in part by two drive wheels, each drive wheel being driven by an electric motor for forward and reverse rotation, a manual control on the rear of the frame for controlling the two drive motors, including a straight handlebar elongated member disposed on an axis transverse to the longitudinal axis of the machine and adapted to be gripped near its ends by an operator, a mounting for the elongated member providing for rotation about its transverse axis and simultaneously pivotable about a second axis in the vertical plane of the longitudinal axis of the machine, a spring bias arrangement for centering the elongated member in an at rest intermediate position about both axes, a pair of motor controllers mounted on the frame for controlling the motors, one for each motor, and a connection between the elongated member and each motor controller, said construction including a pair of generally parallel levers extending radially from the longitudinal member, a lever extending radially from each controller and generally parallel to each other, and a link between each lever on the elongated member and a lever on one of the controllers, the connection being constructed and arranged to integrate the rotary and pivotal motions of the elongated member so that rotation of the elongated member about its transverse axis and pivoting of the elongated member about its axis in the vertical plane of the longitudinal axis of the machine in combination will produce a single resultant motion of each of the motor controllers, and so that either rotation of the elongated member about its transverse axis or pivoting of the elongated member about its axis in the vertical plane of the longitudinal axis of the machine will produce a resultant motion in each of the motor controllers.

12. The machine of claim 11 further characterized in that the links are approximately at right angles to the levers when the elongated member is in its at rest intermediate position.

13. The machine of claim 11 further characterized in that the levers extending radially from the elongated member are generally parallel to the pivot axis of the elongated member.

14. In a floor maintenance machine with a longitudinal axis to be operated by a person walking behind it and adapted for forward and reverse travel over a floor, a frame supported at least in part by two drive wheels, each driven individually by an electric motor, each motor being capable of forward and reverse rotation and variable speed, a manual control for controlling the two motors equally or differentially in speed and direction of rotation comprising a straight elongated member with a first axis disposed centrally thereof in the direction of the length dimension of the elongated member and transverse to the longitudinal axis of the machine, the elongated member being adapted to be gripped near its ends by an operator and being movable with a first rotary motion about its first axis and in a second rotary motion about a second axis in the vertical plane of the longitudinal axis of the machine, an operative connection between the elongated member and each motor including first and second control devices controlling respectively first and second motor controllers each of which in turn controls the direction and speed of rotation of one of the drive motors, rotation of the elongated member about its first axis alone causing both motors to be operated at equal speeds in either forward or reverse rotation, rotation of the elongated member about its second axis alone causing one motor to be operated in forward rotation and the other in reverse rotation, and rotation of the elongated member simultaneously about both axes causing both motors to be operated in forward or reverse rotation and at differential variable speeds proportional to the combined degrees of rotation of the elongated member about both axes.

* * * * *